United States Patent [19]

Harvey et al.

[11] 4,389,166

[45] Jun. 21, 1983

[54] SELF-CONTAINED PORTABLE AIR COMPRESSOR

[75] Inventors: Gerald J. Harvey, Woodmere; Elliot Huff, Jr., St. James, both of N.Y.

[73] Assignee: Harvey-Westbury Corp., Westbury, N.Y.

[21] Appl. No.: 87,009

[22] Filed: Oct. 22, 1979

[51] Int. Cl.[3] ..... F04B 35/04

[52] U.S. Cl. ..... 417/234

[58] Field of Search ..... 417/234, 411, 415

[56] References Cited

U.S. PATENT DOCUMENTS

| | | | |
|---|---|---|---|
| 3,243,100 | 3/1966 | Adams | 417/411 X |
| 3,861,894 | 1/1975 | Marsh | 417/411 X |
| 3,885,892 | 5/1975 | Dwyer | 417/234 |
| 4,187,058 | 2/1980 | Fish | 417/234 |

*Primary Examiner*—Richard E. Gluck

*Attorney, Agent, or Firm*—Weinstein & Sutton

[57] ABSTRACT

A lightweight, miniaturized, portable air compressor of the reciprocating piston type. Drive is imparted to the reciprocating piston by means of an input shaft which rotates a belt crank to convert rotary motion to reciprocating motion. The compressor housing has an integral bracket for mounting a DC motor and gear train coupling the DC motor output to the compressor input shaft. A pair of one way valves regulate the intake of air prior to compression and the exiting of compressed air from the piston chamber for introduction therein to a flexible air hose. The compressor is secured within a recess provided in the tray portion of a housing comprised of hingedly connected lid and tray members. A large hollow recess is provided for storage of the elongated air hose and an elongated power cord. Shallow recesses are provided for positioning and aligning the innermost portions of the air hose and electrical power cord when these members are unwound and extended outside of the exterior of the housing during the time that the compressor is in operation. The compressor is designed to operate when the housing is in the fully closed position, appropriate recesses being provided by the cooperating mating edges of the lid and tray portions to provide for free movement of air into and out of the housing and to allow the air hose and electrical power cord to extend away from the closed housing without interfering with their normal use and handling.

11 Claims, 12 Drawing Figures

SELF-CONTAINED PORTABLE AIR COMPRESSOR

BACKGROUND OF THE INVENTION

The present invention relates to compressors and more particularly to a portable miniaturized compressor and cooperating housing which, when closed, permits the compressor to be safely stored when not in use and to be fully operative when the housing is in the closed position.

Air inflated objects are utilized in a wide variety of activities and fields. For example, tires in the field of transportation, footballs, basketballs, soccer balls and the like in the field of sports and inflatable toys for children, as well as a myriad of uses in industrial and commercial fields. Applications around the home may be satisfactorily accomodated through smaller, less powerful units than those normally required for industrial and commercial applications. In addition, it is most advantageous to provide a compressor which is inexpensive, lightweight and portable and of a rugged construction to protect the compressor from being damaged during use or due to rough handling which is normally anticipated due to the outdoor and emergency-type of applications in which the compressor is employed.

BRIEF DESCRIPTION OF THE INVENTION

The present invention is characterized by comprising a miniaturized, portable, lightweight, inexpensive compressor including a compressor housing having an integral rugged mounting bracket for joining the compressor to a miniaturized motor drive. The compact size compressor/motor combination is secured within a housing comprised of hingedly connected lid and tray portions secured to one another by a releasable latch when in the closed position and capable of being opened for conditioning the compressor for either use or storage after use. The tray portion of the housing is provided with a first recess for mounting the compressor/motor combination and a second recess for storing the electrical cord and an air hose preferably in coiled fashion.

When it is desired to operate the compressor the lid is opened, the air hose and electrical cord are uncoiled and laid upon respective guideway recesses provided within the housing tray portion whereupon the lid is then closed and secured by the aforesaid locking member enabling the unimpeded use of the compressor with the container in the closed position.

The motor is preferably a DC motor powered by a DC source such as for example a 12 volt battery. An adapter is provided for coupling into a cigarette lighter socket typically provided on the dashboard or control panel of a land vehicle such as an automobile or truck or a marine craft. The free end of the air hose is provided with an air chuck for releasable airtight connection with the valve stem of the object to be inflated such as for example a pneumatic tire. Additional adapters are provided for establishing an airtight coupling with different types of valve stems, said adapters being releasably inserted into the air chuck to facilitate inflation of diverse items such as inflatables having large openings such as air mattresses, inflatable toys and the like and inflatables having pinhole openings such as footballs, basketballs, soccer balls and the like. The tray portion is provided with recesses for the convenient storage and removal of the adapters.

Once the electrical power cord and air hose have been placed in their associated guideways and extended from the container, the housing is closed and locked. The power cord and air hose are then respectively connected to a suitable source of electrical power and the device to be inflated. The housing is formed of a durable, rugged, high impact plastic material which completely encloses the motor and compressor both when in use and when being stored and/or transported and which completely protects the motor and compressor from being damaged during normal use or even as a result of rough handling. The design of the lid and tray portions is such as to provide guide recesses for neatly positioning and maintaining the electrical power cord and air hose in their desired orientation both when in use and when stored and further provides openings for the free passage of air entering into and expelled from the air compressor when in use. The extremely small size and light weight of the compressor significantly reduces the load imposed upon the drive motor providing a highly efficient compressor having an extremely favorable power to size ratio.

The extremely small size of the compressor/motor combination combined with the unique design of the container provides an extremely lightweight and compact device which facilitates both handling and storage of the unit.

OBJECTS OF THE INVENTION AND BRIEF DESCRIPTION OF THE FIGURES

It is therefore one object of the invention to provide a novel combination motor/compressor and storage container therefor adapted to completely enclose the motor/compressor during both storage and use to protect the motor/compressor from being damaged during handling.

Still another object of the present invention is to provide a novel motor/compressor and housing therefor wherein the housing is designed to store all of the motor/compressor components including the air hose and power cord and to allow unimpeded use of the air hose and power cord during operation of the compressor with the housing in the fully closed position to protect the motor/compressor from being damaged when in use.

Still another object of the present invention is to provide a novel motor/compressor and housing therefor of the character described wherein the compressor is of a highly simplified design and incorporates bracket means for proper orientation and securement of the motor and compressor as well as a gear train for coupling power from the motor to the compressor.

The above, as well as other objects of the present invention will become apparent when reading the accompanying description and drawings in which.

DETAILED DESCRIPTION OF THE INVENTION

Figure 1:
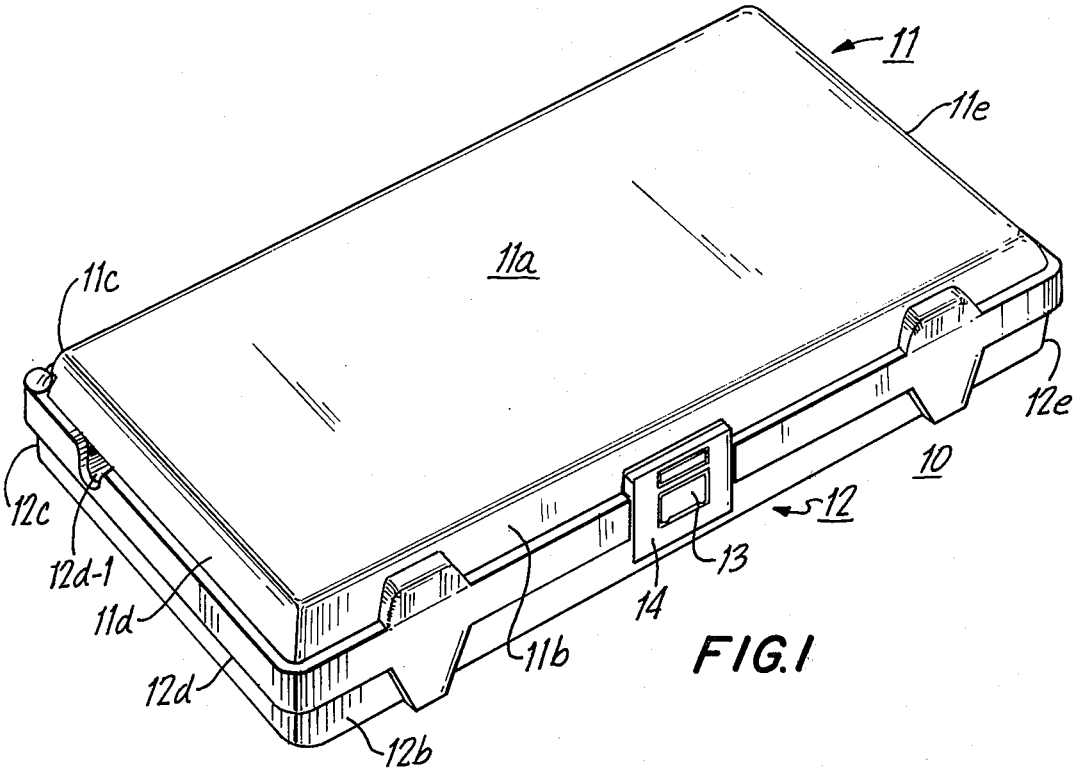
FIG. 1 is a three quarter perspective view showing the top, front and lefthand sides of the motor/compressor housing of the present invention.
Figure 2:
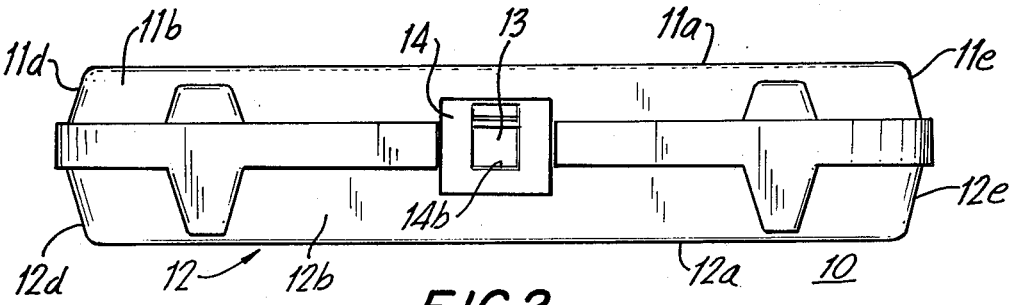
FIGS. 2, 3, 4 and 5 show front elevational, lefthand side elevational, rear elevational and righthand side elevational views respectively of the housing of FIG. 1.
Figure 3:
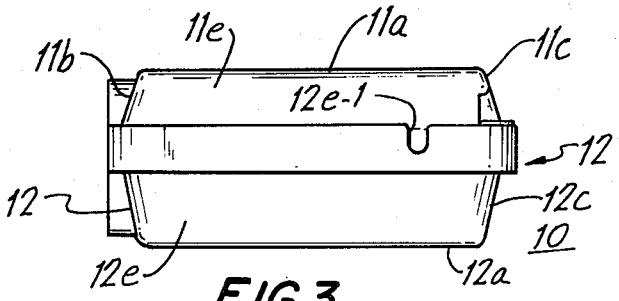

FIGS. 1 through 6 show a housing assembly 10 for use in housing the motor/compressor unit to be described in more detail hereinbelow, which container 10 is comprised of a tray portion 12 hingedly connected to a lid portion 11. The housing 10 in the fully closed position, as shown best in FIGS. 1 through 5, has a substantially rectangular shape. The lid portion 11 is comprised of a top 11*a*, longitudinal front and rear side walls 11*b* and 11*c* and left and righthand end walls 11*d* and 11*e*, all of said walls 11*b* through 11*e* being slightly diagonally aligned. The walls 11*b* through 11*e* and integral major surface 11*a* cooperate to form an internal, shallow recess 11*f* shown best in FIG. 6. Lid 11 is preferably molded of a high impact plastic material.

Figure 7:
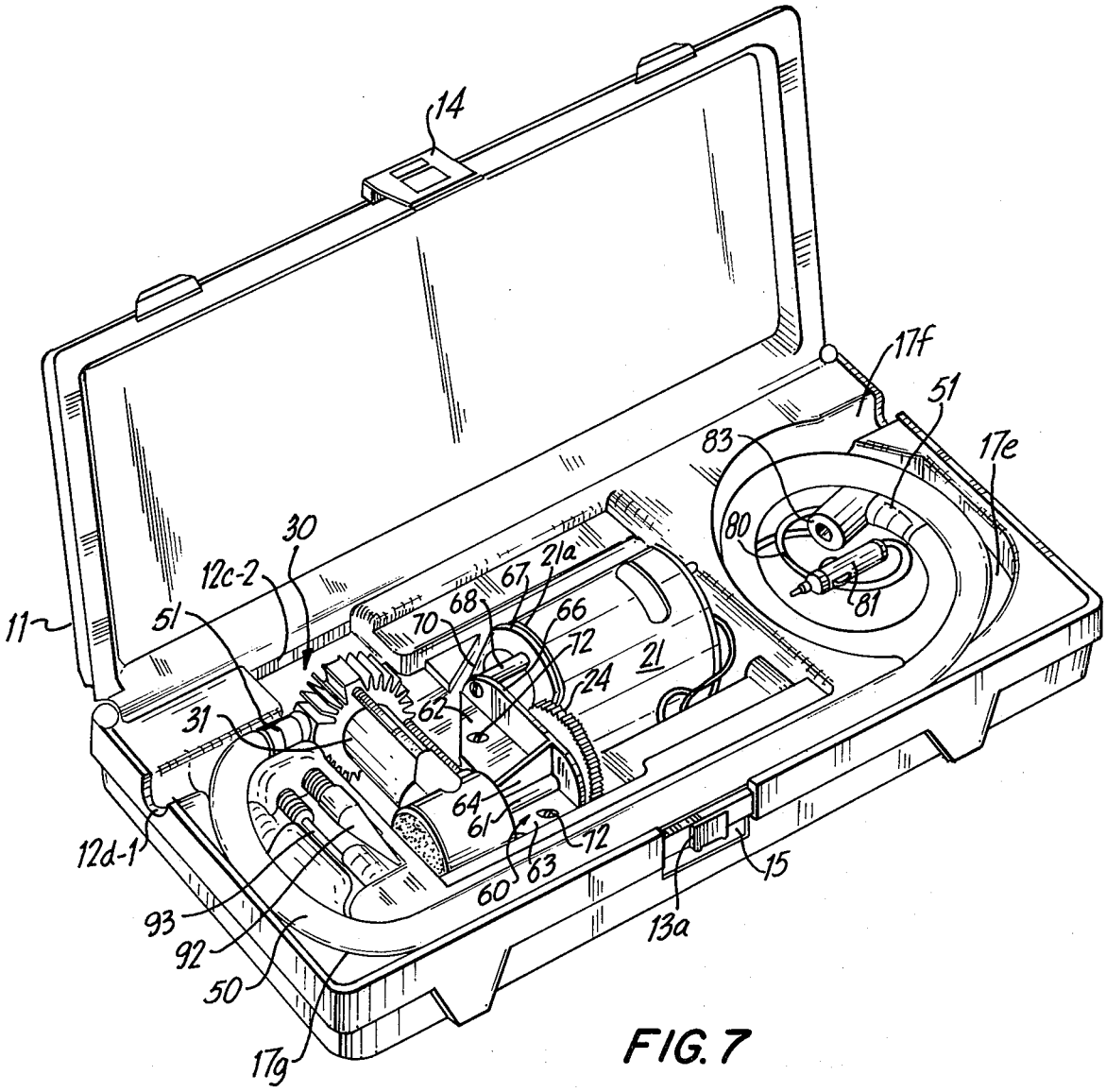
FIG. 7 shows a perspective view of the combination motor/compressor and housing of the present invention showing the lid portion of the housing in the open position to expose the motor/compressor and connecting members stored within the tray portion of the housing.
Figure 7B:
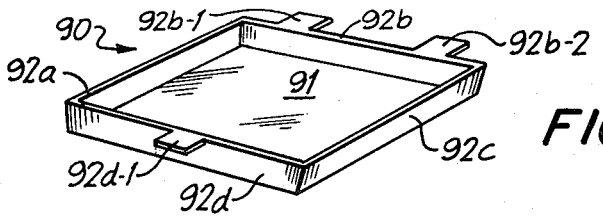
FIG. 7B is a perspective view showing the bottom of the releasable cover member shown in FIG. 7A for covering the motor/compressor inside the housing.
Figure 7A:
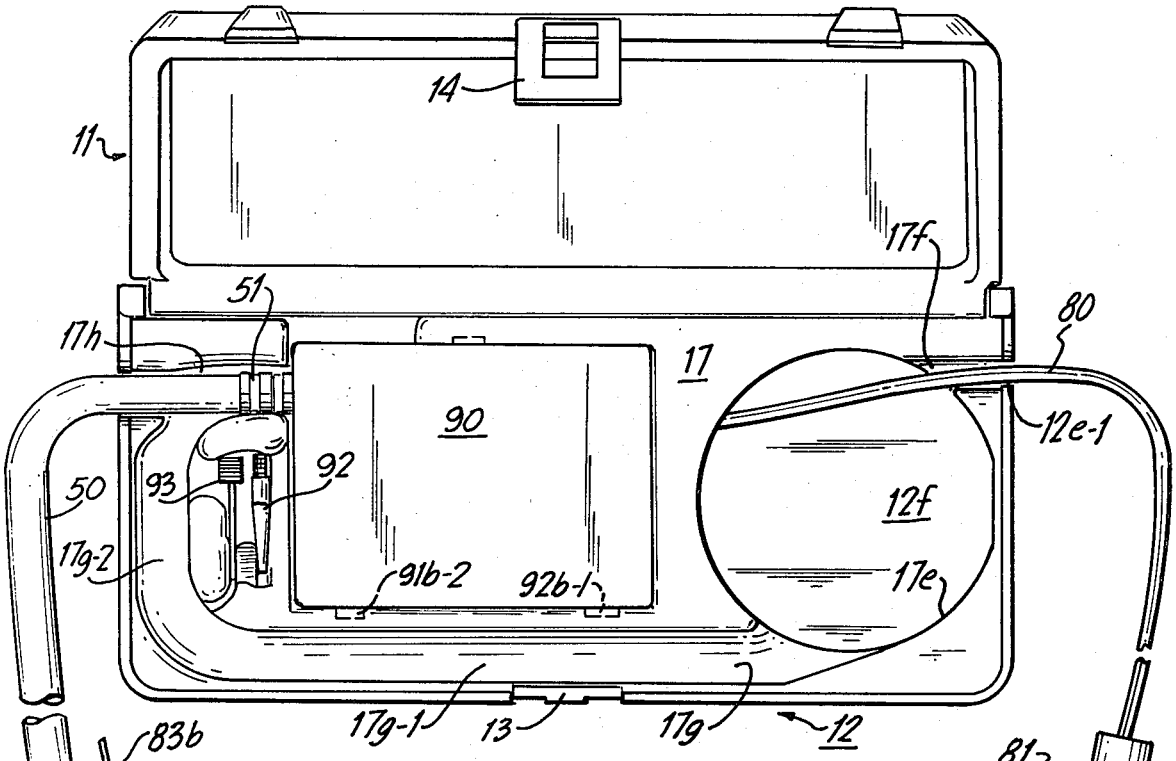
FIG. 7A shows a plan view of the motor/compressor and housing of FIG. 7 with the lid portion in the fully opened position and the air hose and power cord in the uncoiled position in readiness for operation of the compressor.
Figure 7C:
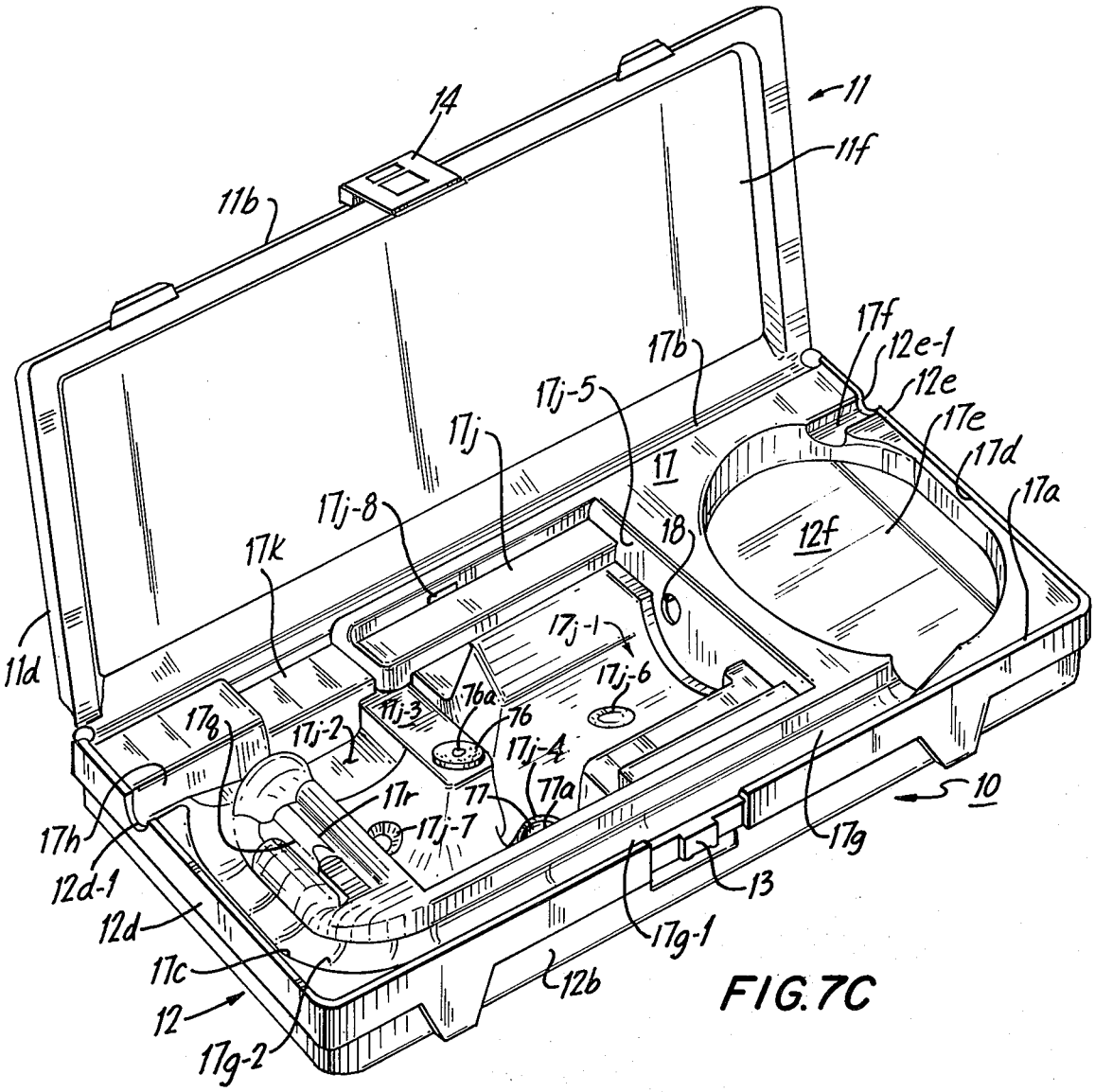
FIG. 7C shows the housing in FIG. 7A with the lid in the open position and with the motor/compressor and connecting air hose and power cord in the operating position.

The tray portion 12 is comprised of a bottom surface 12*a*, a pair of longitudinal front and rear side walls 12*b* and 12*c* and pair of end walls 12*d* and 12*e*, all of said walls 12*b* through 12*e* being integrally joined to bottom member 12*a* and defining a shallow recess 12*f* shown best, for example, in FIG. 7C, within the interior of the tray portion 12. The tray portion 12 may also be molded of a high impact plastic material.

The longitudinal front side wall 12*b* is provided with a substantially rectangular-shaped projection 13 surrounded on three sides by a U-shaped recess 15. The underside of projection 13 has an undercut groove 13*a* (note especially FIG. 7). The U-shaped recess 15 is designed to receive the lower portion of locking member 14 which is integrally joined to side wall 11*b* of lid portion 11 and has a square-shaped opening 14*a* for receiving and embracing projection 13. The portion of the locking member 14 defining the lower edge 14*b* of opening 14*a* is provided with an upwardly extending projection 14*c* which is snapfittingly received within the undercut recess 13*a* provided beneath projection 13. Projection 13 further is provided with a surface 13*b* for guiding projection 14*c* when locking member 14 is snapped into the locking position embracing projection 13. The diagonal alignment of the front wall 12*b* of tray portion 12 provides sufficient clearance beneath the lower edge 14*d* of locking member 14 (note FIG. 6) to facilitate gripping by the fingers of an operator in order to move locking member 14 away from the locked position with projection 13 and its undercut groove 13*a*.

The lid and tray portions 11 and 12 as well as the locking member 14 are formed of a suitable lightweight and yet rugged plastic material adapted to withstand normal and even rough handling to provide an enclosure for the motor/compressor (to be more fully described) which protects the motor/compressor mechanism from damage or abuse.

Figure 4:
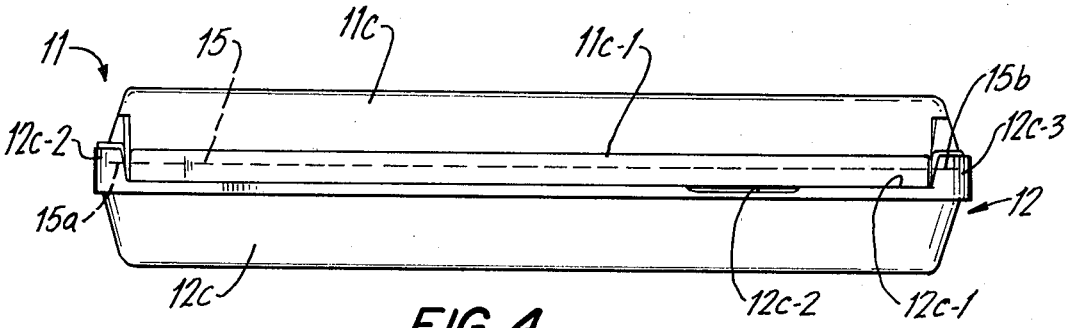
Figure 5:
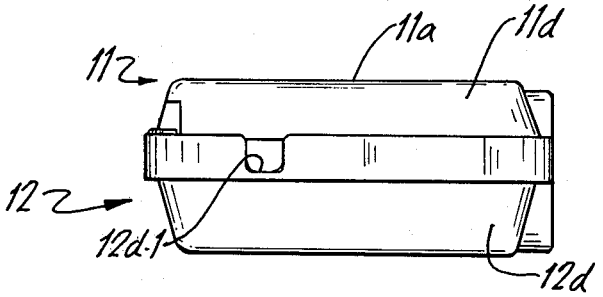
Figure 6:
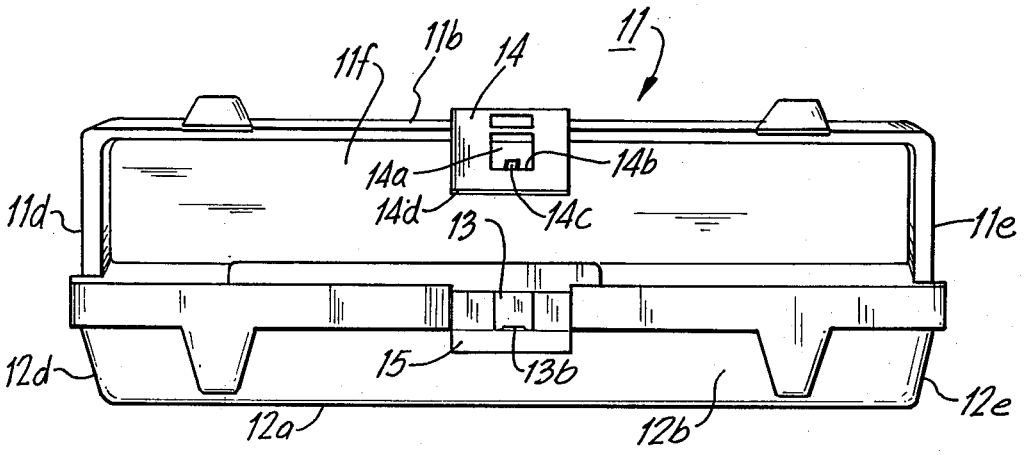
FIG. 6 shows a front elevational view of the housing of FIG. 1 with the lid partially lifted relative to the tray portion thereof.

The rear end wall 12*c* of tray portion 12 is provided with an elongated recess 12*c*-1 extending almost the entire length of the upper edge of rear side 12*c*, as can best be seen in FIG. 4. The rear side wall 11*c* of lid portion 11 has a height which is greater than the front side wall 12*b* and end walls 12*d* and 12*e* and which is designed to fit within the recess 12*c*-1 so that the extended length portion 11*c*-1 of lid 11 fits within the elongated recess 12*c*-1 of tray portion 12. The extended length portion 11*c*-1, although not shown for purposes of simplicity, is provided with an elongated bore running the entire length of the extended length portion 11*c*-1. The bore is adapted to receive an elongated hinge pin 15 shown in dotted line fashion in FIG. 4. The free ends 15*a* and 15*b* of hinge pin 15 extend into fittings (not shown) within the opposite ends 12*c*-2 and 12*c*-3 of rear wall 12*c* to provide a hinged connection between the lid 11 and tray 12.

Considering FIG. 7C, housing 10 is shown in the open position wherein tray portion 12 is shown in a horizontal position which it would normally occupy when resting upon a horizontal surface and with lid portion 11 lifted about the hinge connecting the lid and tray portions 11 and 12 so that the lid is aligned substantially vertically. As was set forth hereinabove, lid portion 11 is provided with an internal recess 11*f*. Similarly, tray portion 12 is provided with a hollow recess 12*f* which is fitted with a molded insert 17 having a substantially rectangular-shaped perimeter which is intergrally joined along its four sides 17*a*, 17*b*, 17*c* and 17*d* to the walls 12*b*, 12*c*, 12*d* and 12*e* respectively of tray portion 12. Insert 17 is preferably molded of the same plastic material as tray portion 12 and is provided with a number of recesses and openings as will be described. The righthand portion of insert 17, relative to FIG. 7C, is provided with a large circular-shaped opening 17*e* which communicates with the floor of the recess 12*f* to define a circular-shaped region for storing the air hose and power cord which will be more fully described hereinbelow. A semicircular-shaped guideway recess 17*f* communicates with the circular-shaped opening 17*e* at one end and with a semicircular-shaped opening 12*e*-1 in tray side wall 12*e* which guideway 17*e* and opening 12*e*-1 cooperatively form a guideway and recess for receiving and positioning the power cord 80 extending between the motor 21 of the motor/compressor (to be more fully described) so as to facilitate the coupling of the power cord 80 to an electric power source (not shown) when the housing 10 is in the fully closed position so that the housing 10 does not interfere with the power cord coupling and vice versa.

A second semicircular-shaped, elongated recess 17*g* is provided in insert 17. The righthand end of recess 17*g* communicates with the circular-shaped opening 17*e* in insert 17. Recess 17*g* may be characterized as being comprised of an elongated straight guideway portion 17*g*-1 and a curved U-shaped guideway portion 17*g*-2. Recess 17*g* serves as a guideway for the portion of the air hose extending from the outlet provided on the compressor 30 (which will be more fully described) and the storage region defined by the circular-shaped opening 17*e* in insert 17 which stores the major portion of the air hose 50, as well as the power cord 80.

The free end of semicircular-shaped recess 17g also merges with a straight semicircular-shaped guideway recess 17h which extends from one edge of the cavity 17j which receives and stores the compressor 30, as will be more fully described and end wall 12d of tray portion 12 which is provided with a semicircular-shaped opening 12d-1 communicating with the lefthand end of recess 17h. Guideway recess 17h receives and supports the portion of the air hose 50 connected to the compressed air outlet of the compressor 30 to facilitate coupling of the air hose 50 to the object to be inflated (not shown) and allow unimpeded operation and use of the compressor 30 and air hose 50 when the housing 10 in the fully closed position.

The central portion of insert 17 is provided with a cavity 17j which has a cavity portion 17j-1 for receiving and positioning the motor 21 and a gear train to be more fully described and a cavity portion 17j-2 for receiving the compressor 30 to be more fully described. The projections 17j-3 and 17j-4 positioned between cavity portion 17j-1 and 17j-2 are adapted to receive and support rib portions of the compressor housing integral mounting bracket (to be more fully described) which secures the motor/compressor within cavity 17j by suitable fastening means extending through openings in the mounting bracket and threadedly fastened to fastening members 76 and 77 arranged in projections 17j-3 and 17j-4 respectively.

The lefthand end of cavity portion 17j-2 communicates with the semicircular-shaped guideway recess 17h which guides that portion of the air hose 50 which couples the compressor 30 to the object to be inflated (not shown). The end of cavity 17j-2 closest to the rear wall 12b of tray portion 12, communicates with a shallow shelf 17k formed in insert 17 and cooperates with an elongated slot 12c-2 in rear wall 12c of tray 12 which serves as an air passageway for allowing air to freely enter into and leave cavity housing 10 during the operation of the compressor 30 and while the housing 10 is in the fully closed and locked condition.

The cavity portion 17j-1 is provided with an upright wall 17j-5 having an opening 18 for receiving the power cord 80, enabling the power cord 80 to extend between the motor arranged in cavity portion 17j-1 and the power cord and air hose storage region defined by the opening 17e in insert 17.

The bottoms of the cavity portions 17j-1 and 17j-2 are each provided with semicircular-shaped recesses 17j-6 and 17j-7 which extend downwardly toward the surface of recess 12f to provide support for the insert 17 upon tray surface 12a and hence the motor 21 and compressor 30 (to be more fully described) while at the same time limiting the engagement between the insert 17 and the bottom surface of recess 12f to a pair of substantially point contacts to prevent vibration of the motor 21 and/or compressor 30 from being imparted to the housing lid or tray portions 11 and 12 through insert 17.

Recess 17 is further provided with a pair of recesses 17q and 17r for receiving and storing the valve adapter members (to be more fully described) when not in use.

Figure 8:
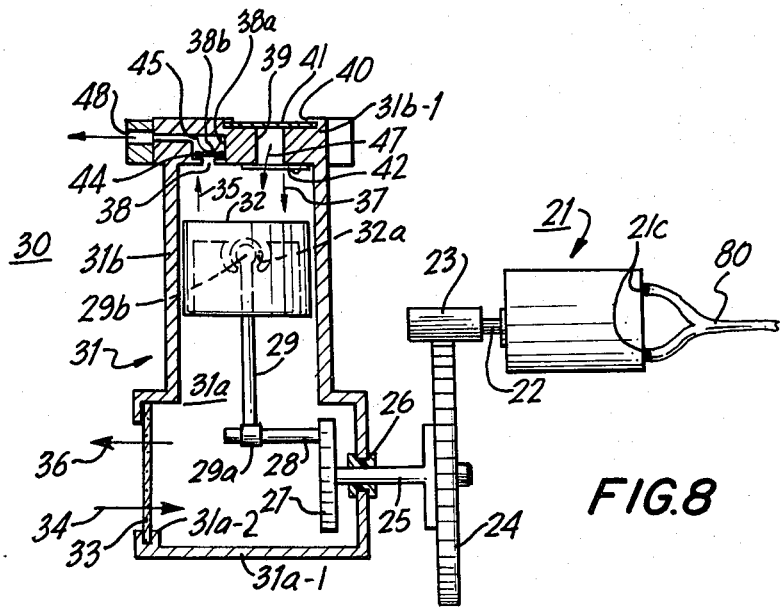
FIG. 8 shows a diagramatic arrangement of the internal components of the compressor.

Turning to a consideration of FIGS. 7, 7A, and 8, it can be seen that the tray portion 12 and insert 17 are adapted to receive and securely support a motor 21 which, as was previously described, is positioned within cavity portion 17j-1. Motor 21 is provided with an output shaft 22 upon which is mounted a pinion gear 23. Noting especially FIG. 8, pinion gear 23 can be seen to mesh with a large diameter driven gear 24 fixedly secured to a driven shaft 25. The compressor 30 comprises a housing 31 having a lower portion 31a including a hollow cylindrical housing 31a-1 for receiving and rotatably supporting shaft 25 through a bearing 26. A disc 27 contained in housing portion 31a is securely fastened to the lefthand end of shaft 25 and has arm 28 mounted near the periphery thereof. A piston connecting arm 29 is provided with an opening 29a for rotatably receiving the free end of crank arm 28. The upper end of connecting arm 29 is provided with a hollow enlarged diameter portion 29b which is snapfittingly received within a socket-like member 32a provided within the hollow interior of piston 32, to form a ball and socket coupling therebetween. Piston 32 is mounted for reciprocal movement within the piston chamber portion 31b of housing 31, connecting rod 29 serving as the means for converting the rotating motion of shaft 25, cylindrical disc 27 and crank arm 28 into the linear reciprocating motion experienced by piston 32.

Housing portion 31a is provided with an enlarged opening 31a-2 for receiving and supporting porous filter member 33 which permits air to freely enter into the hollow interior of housing portion 31a, in a direction shown by arrow 34, when piston 32 moves upwardly in the direction shown by arrow 35. Conversely, air freely passes outwardly through porous filter member 33 in a direction shown by arrow 36 as piston 32 moves in the downward vertical direction as shown by arrow 37. The porous member 33 serves as a filter means which allows the free entry into and egress of air from the interior of housing portion 31a while at the same time preventing moisture and/or foreign particles from entering into the interior of housing portion 31a. Opening 31a-2 prevents any pressure build-up in housing portion 31a.

The upper end of housing portion 31b which forms the piston chamber, is provided with a pair of small openings 38 and 39. Opening 39 communicates with a larger opening 40 which positions and supports a porous filter member 41. Opening 39 is normally sealed by a resilient, one-way, metallic flap-valve member 42 secured to portion 31b-1 of the housing portion 31b.

Opening 38 has an enlarged diameter portion 38a forming a shoulder 38b with opening 38. A one-way valve member in the form of a disc 44 is arranged to seal opening 38 and is normally pressed downwardly to be seated upon shoulder 38b by means of spring 45. The operation of the one-way valve assemblies and of the compressor 30 is as follows.

As piston 32 moves downwardly from its top dead center position, i.e. the position in which the volume between the upper surface of piston 32 and the upper end of the piston chamber is smallest, the interior region defined by the piston chamber and the piston 32 creates a vacuum condition within the piston chamber. The differential pressure across the flap valve member 42 causes the air at atmospheric pressure to press against the flap valve 42, moving it in the direction shown by arrow 47 to unseal opening 39 and allow air at atmospheric pressure to enter into the piston chamber.

As soon as piston 32 reaches its bottom dead center position (i.e. when the volume defined by the piston chamber and the piston is the largest) piston 32 begins to move upwardly and compresses the air which previously entered into the piston chamber. The compressed air serves to maintain flap valve 42 closed. However, when the air reaches a predetermined compression value, the compressed air lifts valve member 44 by overcoming the force of spring 45 exerted upon valve member 44 whereupon the compressed air of at least said predetermined value escapes through the opening between shoulder 38*b* and disc-shaped valve member 44 and through horizontally aligned opening 48 to enter into the air hose 50 communicating with opening 48 by means of a coupling member 51 which couples air hose 50 to the compressor 30. The cycle is repeated in this fashion whereby the compressor draws air under atmospheric pressure into the piston chamber during an aspiration stroke and compresses the air and forces the compressed air outwardly through an opening 48 in the compressor 30 and the air hose 50 communicating therewith during a compression stroke. Porous filter 41 similar to porous filter 33, serves to allow air to enter into the piston chamber while at the same time preventing the ingress of moisture and/or foreign particles.

Although compressor 30 is quite small, having a length of less than two and one-half inches, it is quite powerful and is capable of generating compressed air at a pressure on the order of 100 psi. Air hose 50 is a flexible hose formed of a rubber or rubber-like material capable of withstanding the pressure developed by compressor 30.

Figure 7D:
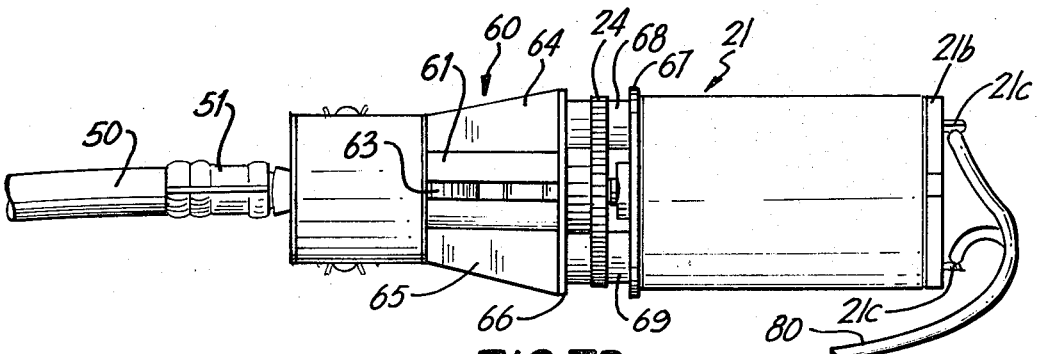
FIG. 7D shows a bottom plan view of the motor/-compressor and interconnecting gear train.

A mounting bracket 60 integral with the compressor housing portion 31*b* serves as the means: for supporting shaft 25 and large diameter gear 24, for securing motor 21 thereto and further for securing the motor 20 and compressor 30 to the insert 17 of the housing assembly 10. The mounting bracket 60 includes an integral, hollow, cylindrical portion 61 for receiving shaft 25 and four ribs 62–65 extending substantially radially outward therefrom. Considering FIG. 7, two of these ribs, 62 and 63, can be seen to be arranged in a coplanar fashion. The remaining two ribs 64 and 65, as shown best in FIGS. 7 and 7D, are likewise arranged in coplanar fashion and are arranged perpendicular to the ribs 62 and 63. The ends of ribs 62–65 remote from the compressor 30 are integrally joined to a substantially oval-shaped plate 66. A substantially circular-shaped disc 67 is arranged in spaced parallel fashion with the oval-shaped plate 66 and is maintained in this orientation by a pair of integral half-cylinder projections 68 and 69 (note especially FIGS. 7 and 7D) and a diagonally aligned rib 70 which members are integrally joined to the oval-shaped plate 66 and circular disc 67. Threaded fasteners extend through oval-shaped plate 66 and the semi-cylindrical-shaped members 68 and 69, to be received by tapped openings provided in the housing front plate 21*a* of motor 21. Ribs 62 and 63 are provided with openings for receiving fasteners 72 which extend through openings in the ribs 62 and 63 and are received by tapped openings 76*a* and 77*a* provided in the members 76 and 77 inserted into projection 17*j*-3 and 17*j*-4 of the motor and compressor receiving cavity 17*j*. The opposite end 21*b* of the housing of motor 21 is provided with a pair of connection terminals 21*c* for coupling to the two wires of power cord 80. The opposite end of power cord 80 is fitted with a special purpose connector 81 for insertion into the socket (not shown) normally adapted to receive a cigarette lighter (not shown) which is typically provided on the dashboard or control panel of a marine craft or of a vehicle such as a car or truck.

As was described hereinabove, the air hose 50 coupled to compressor 20 by coupling 51 is provided with an air chuck assembly 83 having an opening (not shown) at its lefthand end 83*a* for receiving the valve stem (not shown) of a pneumatic tire, for example. The opposite end of the air chuck assembly 83 is provided with a pivotally mounted lever 83*b* for locking the valve stem which has been inserted into the opening in end 83*a* in order to provide a substantially airtight seal between the air chuck 83 and the valve stem to insure delivery of all of the compressed air from compressor 30 through the valve stem (not shown) and into the pneumatic tire.

Since neither the motor 21 nor the compressor 30 normally require any adjustments or handling either prior to or during normal operation, the compressor unit housing 10 is further provided with a removable cover 90 shown best in FIGS. 7A and 7B and which is comprised of a shallow housing formed by a cover surface 91 and four short side- walls 92*a* through 92*d*. Side wall 92*b* is provided with a pair of outwardly directed projections 92*b*-1 and 92*b*-2. Side wall 92*d* is provided with an outwardly directed projection 92*d*-1. The vertical side walls on two opposing sides of cavity 17*j* are provided with slots for receiving the projections 92*b*-1, 92*b*-2 and 92*d*-1, one of said slots 17*j*-8 being shown in FIG. 7C. Member 90 which is preferably formed of a lightweight, inexpensive, resilient plastic material, is positioned upon cavity 17*j* with the flanges 92*b*-1, 92*b*-2 and 92*d*-1 arranged in the slots as shown best in FIG. 7A. Motor 21 and compressor 30 normally remain covered in this manner during both storage and operation since motor 21 and compressor 30 are substantially maintenance free.

FIG. 7 shows the motor/compressor unit in the storage position wherein a portion of the air hose 50 is arranged within the semicircular-shaped recess 17*g* so as to extend between the outlet end of compressor 30, connected to coupler 51 on the one hand and into the semicircular-shaped opening 17*e* in insert 17 wherein the air chuck 83 and coiled remainder of the air hose 50 are stored. In a similar manner, adapter 81 and the coiled portion of power cord 80 are stored within the remaining region of opening 17*e* receiving the coiled air hose 50 and air chuck 83. The lid 11 may be lowered from the position shown in FIG. 7 to the position shown in FIG. 1 and locking member 14 moved to the locked position relative to projection 13 to provide a very compact assembly in the stored position.

To use the air compressor unit, after opening locking member 14 and raising lid 11, the power cord 80 and the air hose 50 lifted out of opening 17*e* and are uncoiled. A portion of power cord 80 is positioned within recess 17*f* and a portion of air hose 50 is positioned within recess 17*h* in the manner shown in FIG. 7A. Lid portion 11 is then moved to the closed position and locking member 14 is moved to the locked position relative to projection 13, enabling the compressor 30 and motor 21 to be operated with the container 10 in the fully closed position to protect the compressor 30 and motor 21, as well as the intermediate gear train, from physical abuse or damage. The unit may be operated from any convenient 12 volt DC power source and is especially adapted for connection into the cigarette lighter socket of an automobile and/or a boat. The compressor unit may be employed as an all purpose pressure maintenance tool which is handy for use in automobiles, recreation vehicles, boats and use around the house. It is small enough to store in the average glove compartment, is lightweight and completely self-contained. It is sufficiently versatile to be used for inflating items such as tires, deflated spares, air shocks, toys, bikes, recreational and boat water systems and inflatables and recreational accessories of all types and varieties, the housing durable high impact case having an extremely low profile to facilitate storage and handling. The adapters 92 and 93 (see FIG. 7A) are arranged within the recesses 17*r* and 17*q* (see FIG. 7C) which forcefittingly received the aforesaid adapters to provide easy access to the adapters as well as providing means for conveniently storing the adapers.

Although this invention has been described with respect to its preferred embodiments, it should be understood that many variations and modifications will now be obvious to those skilled in the art, and it is preferred, therefore, that the scope of the invention be limited, not by the specific disclosure herein, only by the appended claims.

What is claimed is:

1. A portable unitary air compressor unit comprising:

a compressor;

a motor;

a common bracket;

gear means for coupling the output of said motor to said compressor;

said motor, said compressor and said gear means being secured to said common bracket;

a power cord for coupling said motor to a power source;

an air hose for coupling said compressor to an inflatable object;

substantially impact proof housing means for enclosing said motor, common bracket, compressor, air hose and power cord, said housing means comprising a lid hingedly connected to a tray movable between an open and a closed position;

said tray including a molded sheet having a first cavity for receiving and supporting said motor, said common bracket and said compressor and a second cavity for storing said air hose and said power cord when not in use;

first and second guideways in said molded sheet for respectively receiving and guiding a portion of said power cord and a portion of said air hose for enabling coupling of said air hose to an inflatable object and coupling of said power cord to a power source when said lid is closed upon said tray whereby said housing completely encloses said compressor, said motor and said gear means when the motor and compressor are in operation to prevent said motor and compressor from being damaged and to facilitate safe movement and handling of said motor and compressor even when energized.

2. The apparatus of claim 1, wherein said tray further includes means for providing a guideway for the free movement of air into and out of said enclosure when the lid is closed upon the tray in order to permit normal operation of said compressor even when said housing is in the closed position.

3. The apparatus of claim 1, further comprising means securing said common bracket to said tray to prevent movement of said motor, gear means and compressor relative to said tray portion even in the event that said housing is in the open position.

4. The apparatus of claim 3, wherein said compressor comprises a piston chamber;

first and second unilateral valve assemblies for respectively allowing the passage of air in only one direction between the interior and exterior of said chamber;

a piston slidably mounted within said piston chamber;

means coupled to said gear means for converting the rotary movement of said gear means into reciprocating movement;

and a connecting rod for coupling said reciprocating movement from said converting means to said piston.

5. The apparatus of claim 4, further comprising a coupler for coupling the air hose to the outlet associated with one of said valve assemblies.

6. The apparatus of claim 5, further comprising a filter covering the opening of the remaining one of said valve assemblies to allow for the intake of air into the piston chamber of the compressor while preventing the entry of moisture or foreign particles into the piston chamber.

7. The apparatus of claim 6, wherein the housing of said compressor means is provided with a port communicating the lower end of the piston chamber with the atmosphere to prevent any pressure build up in the portion of the lower end of the piston chamber containing said connecting rod and converting means; and a filter covering said port to allow for the free movement of air therethrough while preventing moisture or foreign particles from entering into the lower end of said piston chamber.

8. The apparatus of claim 1, wherein said tray further includes a third guideway for removably supporting and guiding a portion of said air hose extending between said compressor and said second cavity.

9. The apparatus of claim 1, wherein said tray further comprises means for releasably receiving and supporting adapter accessories; and adapter accessories positioned in said accessory receiving means, said adapter accessories receiving means being positioned to facilitate ready access to said adapter accessories.

10. The apparatus of claim 1, further comprising a locking means for releasably securing said lid to said tray when the enclosure means is in the closed position during either operation or storage of said unit.

11. The apparatus of claim 1, wherein said common bracket comprises a hollow, elongated, cylindrical member;

said gear means comprising a plurality of meshing gears;

a shaft rotatably mounted within said cylindrical member for supporting one gear of said gear means;

a plurality of ribs integral with said cylindrical member and extending outward from the exterior surface of said cylindrical member for imparting structural strength to said cylindrical member;

a first mounting plate integrally joined to said ribs;

a second mounting plate spaced from said first mounting plate;

means for integrally joining said first and second mounting plate and adapted to receive fastening means for joining said motor to said first and second mounting plates;

fasteners extending through at least one of said ribs being threadedly secured to said first cavity means for securing said common bracket to said tray thereby securing said motor and compressor against movement within said tray.

* * * * *